US007090799B2

(12) United States Patent
Takesue et al.

(10) Patent No.: US 7,090,799 B2
(45) Date of Patent: Aug. 15, 2006

(54) GOLF BALL AND METHOD FOR PREPARING GOLF BALL

(75) Inventors: Rinya Takesue, Chichibu (JP); Hiroyuki Nagasawa, Chichibu (JP); Toshihiko Manami, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 155 days.

(21) Appl. No.: 10/795,451

(22) Filed: Mar. 9, 2004

(65) Prior Publication Data

US 2005/0202904 A1 Sep. 15, 2005

(51) Int. Cl.
*A63B 37/12* (2006.01)
*A63B 37/00* (2006.01)

(52) U.S. Cl. ..... 264/279.1; 264/328.1; 473/378; 525/74; 525/92 C; 525/123; 525/125; 525/127; 525/424; 525/440; 525/457; 525/458

(58) Field of Classification Search ..... None
See application file for complete search history.

(56) References Cited

U.S. PATENT DOCUMENTS

| | | | | |
|---|---|---|---|---|
| 4,337,947 | A | 7/1982 | Saito et al. | |
| 4,707,398 | A * | 11/1987 | Boggs | 442/329 |
| 4,919,434 | A | 4/1990 | Saito | |
| 6,123,628 | A * | 9/2000 | Ichikawa et al. | 473/371 |
| 6,319,152 | B1 | 11/2001 | Takesue et al. | |
| 6,458,307 | B1 * | 10/2002 | Inoue et al. | 264/232 |

FOREIGN PATENT DOCUMENTS

| | | | |
|---|---|---|---|
| JP | 56-83367 | A | 7/1981 |
| JP | 62-275480 | A | 11/1987 |
| JP | 11-9721 | A | 1/1999 |

* cited by examiner

*Primary Examiner*—David J. Buttner
(74) *Attorney, Agent, or Firm*—Sughrue Mion, PLLC

(57) ABSTRACT

The invention provides a golf ball comprising a core and a cover of one or more layers, characterized in that at least one layer which constitutes the cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, and (B) an isocyanate compound or an isocyanate mixture having at least two isocyanate groups as functional groups in a molecule, and a method for preparing the same. The golf ball has excellent flight performance, feel on impact, and scuff resistance.

16 Claims, 1 Drawing Sheet

GOLF BALL AND METHOD FOR PREPARING GOLF BALL

BACKGROUND OF THE INVENTION

This invention relates to a golf ball comprising a core and a cover of one or more layers and a method for preparing the same, and more particularly, to a golf ball having excellent properties including flight performance, feel on impact, and scuff resistance and a method for preparing the same.

From the past, resin materials such as polyurethane and ionomer resins are used as golf ball cover stock. Golf balls using polyurethane in the cover stock are soft and improved in feel on impact, controllability and the like, but have the drawback of poor ball rebound. Also, golf balls using ionomer resins in the cover stock are good in rebound and durability, but lack flexibility and give a hard ball touch. Then a variety of polymer blend cover stocks have been proposed in order to compensate for the drawbacks of the respective cover stocks.

For instance, a mixture of an ionomer resin and a polyester elastomer (JP-A 56-83367 and JP-A 62-275480) is arrived at by mixing a polyester block copolymer featuring flexibility and resilience with an ionomer resin featuring extreme toughness and rebound resilience. This mixture makes use of the advantageous properties of both the components and is especially effective for rebound improvement.

The above mixture, however, has a non-uniform morphology since the polyester block copolymer and the ionomer resin are not regarded as a combination of fully compatible materials. When this mixture is used as a golf ball cover stock, there arise drawbacks including low scuff resistance of the cover upon iron shots and insufficient durability upon repeated impact.

JP-A 11-9721 describes a golf ball in which a blend of a thermoplastic polyurethane and a styrene base block copolymer is used as a base of cover stock in order to improve the scuff resistance of the cover stock. The ball, however, is insufficient in rebound and scuff resistance. There is a need for further improvement.

SUMMARY OF THE INVENTION

An object of the present invention, which is made under the above circumstances, is to provide a golf ball having a good overall profile of three properties, flight performance, feel on impact, and scuff resistance, and a method for preparing the same.

Making extensive investigations on a golf ball comprising a core and a cover of one or more layers to achieve the above object, the inventors have discovered as a first aspect that when at least one layer that constitutes the cover is formed by mixing (A) a thermoplastic resin composition selected from among a thermoplastic block copolymer, polyester base elastomer, polyamide base elastomer and polyolefin, which are modified with functional groups having reactivity with isocyanate, for example, maleic anhydride, hydroxyl or amino groups, with (B) an isocyanate compound or an isocyanate mixture having at least two isocyanate groups as functional groups in a molecule, in a predetermined proportion and at room temperature, and injection molding a resin material primarily comprising the mixture around the core so that the golf ball has a cover primarily comprising the mixture of components (A) and (B), the resulting golf ball is improved not only in rebound, but also in feel on impact and scuff resistance. The present invention is predicated on this discovery.

Making extensive investigations on a golf ball comprising a core and a cover of one or more layers to achieve the above object, the inventors have discovered as a second aspect that when at least one layer that constitutes the cover is formed by kneading (A) a thermoplastic resin composition selected from among a thermoplastic block copolymer, polyester base elastomer, polyamide base elastomer and polyolefin, which are modified with functional groups having reactivity with isocyanate, with (C) an ionomer resin to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core so that the golf ball has a cover primarily comprising the mixture of components (A), (B) and (C), the resulting golf ball is improved not only in rebound, but also in feel on impact and scuff resistance. The present invention is predicated on this discovery.

Making extensive investigations on a golf ball comprising a core and a cover of one or more layers to achieve the above object, the inventors have discovered as a third aspect that when at least one layer that constitutes the cover is formed by kneading (A) a thermoplastic resin composition selected from among a thermoplastic block copolymer, polyester base elastomer, polyamide base elastomer and polyolefin, which are modified with functional groups having reactivity with isocyanate, with (D) a thermoplastic polyurethane elastomer to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core so that the golf ball has a cover primarily comprising the mixture of components (A), (B) and (D), the resulting golf ball is improved not only in rebound, but also in feel on impact and scuff resistance. The present invention is predicated on this discovery.

Accordingly, the present invention provides golf balls and methods for preparing the same as defined below.

[1] A golf ball comprising a core and a cover of one or more layers, characterized in that at least one layer which constitutes said cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, and (B) an isocyanate compound or an isocyanate mixture having at least two isocyanate groups as functional groups in a molecule.

[2] The golf ball of [1], wherein in component (A), the functional group having reactivity with isocyanate is a maleic anhydride, hydroxyl or amino group.

[3] The golf ball of [1] or [2], wherein a mixing proportion of component (A) to component (B) is between 100:1 and 100:30 in weight ratio.

[4] A method of preparing a golf ball by injection molding a cover of one or more layers around a core, characterized by mixing (A) a thermoplastic resin composition selected from among a thermoplastic block copolymer, polyester base elastomer, polyamide base elastomer and polyolefin, which are modified with functional groups having reactivity with isocyanate, with (B) an isocyanate compound or an isocyanate mixture having at least two isocyanate groups as functional groups in a molecule, at room temperature, and injection molding a resin material primarily comprising the mixture around the core.

[5] A golf ball comprising a core and a cover of one or more layers, characterized in that at least one layer which constitutes said cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, (B) an isocyanate compound or an isocyanate mixture having at least two isocyanate groups as functional groups in a molecule, and (C) an ionomer resin.

[6] The golf ball of [5], wherein in component (A), the functional group having reactivity with isocyanate is a maleic anhydride, hydroxyl or amino group.

[7] The golf ball of [5] or [6], wherein a mixing proportion of the sum of components (A) and (C) to component (B) is between 100:1 and 100:30 in weight ratio.

[8] A method of preparing a golf ball by injection molding a cover of one or more layers around a core, characterized by kneading (A) a thermoplastic resin composition selected from among a thermoplastic block copolymer, polyester base elastomer, polyamide base elastomer and polyolefin, which are modified with functional groups having reactivity with isocyanate, with (C) an ionomer resin to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core.

[9] A golf ball comprising a core and a cover of one or more layers, characterized in that at least one layer which constitutes said cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, (B) an isocyanate compound or an isocyanate mixture having at least two isocyanate groups as functional groups in a molecule, and (D) a thermoplastic polyurethane elastomer.

[10] The golf ball of [9], wherein in component (A), the functional group having reactivity with isocyanate is a maleic anhydride, hydroxyl or amino group.

[11] The golf ball of [9] or [10], wherein a mixing proportion of the sum of components (A) and (D) to component (B) is between 100:1 and 100:30 in weight ratio.

[12] A method of preparing a golf ball by injection molding a cover of one or more layers around a core, characterized by kneading (A) a thermoplastic resin composition selected from among a thermoplastic block copolymer, polyester base elastomer, polyamide base elastomer and polyolefin, which are modified with functional groups having reactivity with isocyanate, with (D) a thermoplastic polyurethane elastomer to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core.

DETAILED DESCRIPTION OF THE INVENTION

Figure 1:
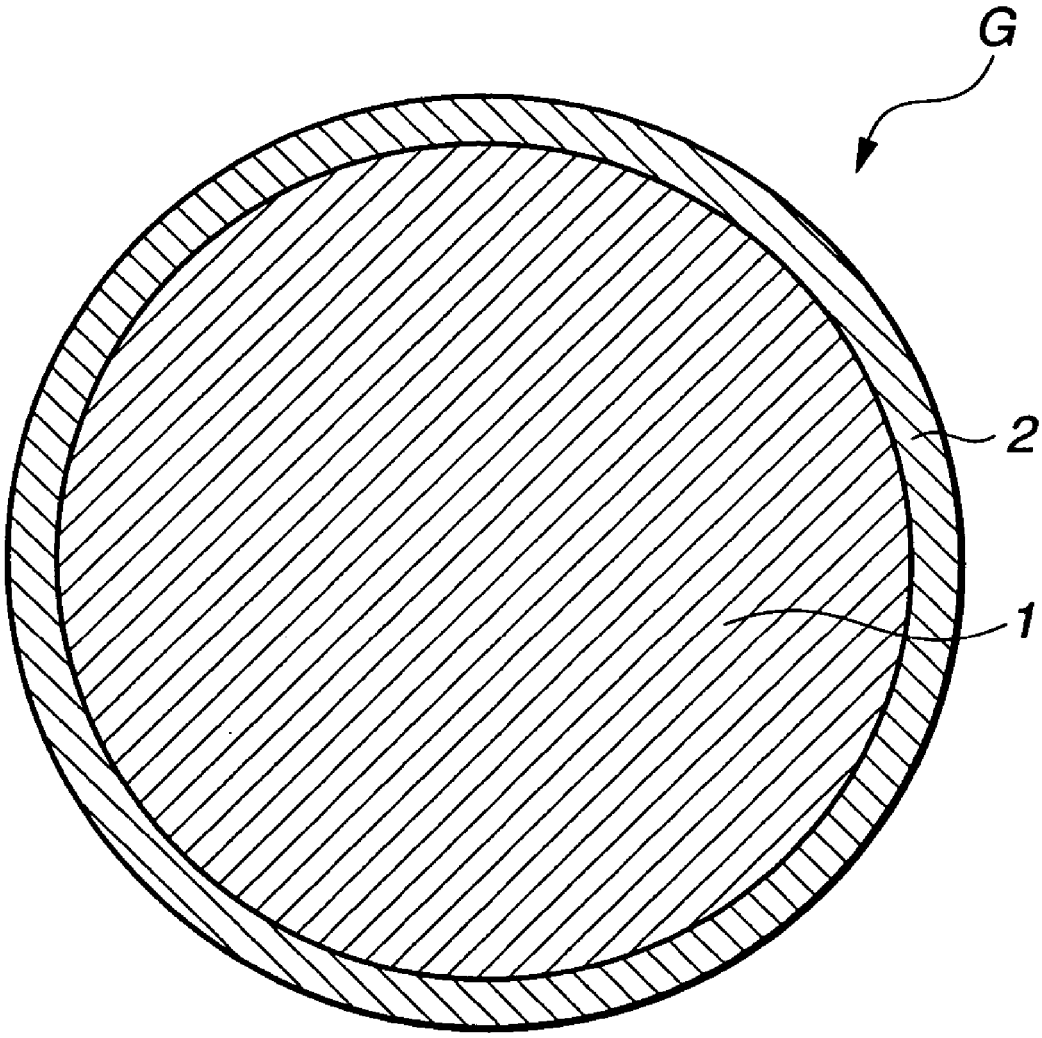
FIG. 1 is a schematic cross-sectional view of a golf ball according to one embodiment of the invention.

Now the present invention is described in more detail.

The golf ball of the invention has a core and a cover of one or more layers. When the cover consists of a single layer, for example, the inventive golf ball is embodied as a two-piece solid golf ball having a solid core 1 enclosed with a single layer cover 2 as shown in FIG. 1.

The material of which the core is made is a rubber composition which is formulated in a conventional way while adjusting vulcanizing conditions, blending ratio and the like. Typically, the core formulation includes a base rubber, a crosslinking agent, a co-crosslinking agent, an inert filler and the like. The base rubber used herein may be any natural rubber and/or synthetic rubber used in solid golf balls in the prior art. For example, 1,4-polybutadiene having a cis structure of at least 40% is employed. If desired, natural rubber, polyisoprene rubber, styrene-butadiene rubber or the like may be blended with the polybutadiene. Examples of the crosslinking agent include organic peroxides such as dicumyl peroxide and di-t-butyl peroxide. Also, the co-crosslinking agent is not particularly limited, and examples include metal salts of unsaturated fatty acids, especially zinc and magnesium salts of unsaturated fatty acids having 3 to 8 carbon atoms (e.g., acrylic and methacrylic acids). Examples of the inert filler include zinc oxide, barium sulfate, silica, calcium carbonate and zinc carbonate. It is noted that instead of the aforementioned rubber composition, thermoplastic resins or elastomers such as ionomer resins or polyester elastomers may also be used as the material of which the solid core is made.

The solid core can be manufactured by vulcanizing and curing a rubber composition comprising the aforementioned components in a well-known process. For example, the solid core can be manufactured by kneading the aforementioned components on a kneader such as a Banbury mixer or roll mill, compression molding or injection molding the mixture in a core mold, and heating the molded part at a sufficient temperature for the peroxide and co-crosslinking agent to act, for example, at a temperature of 130 to 170° C., especially 150 to 160° C. for 10 to 40 minutes, especially 12 to 20 minutes, when dicumyl peroxide is used as the peroxide and zinc acrylate is used as the co-crosslinking agent, thereby curing the molded part.

The hardness of the solid core is not particularly limited and may be properly adjusted. With respect to a hardness distribution, the hardness of the solid core may be either substantially equal or different between the center and the surface of the core.

It is noted that the solid core preferably has a diameter of at least 25 mm, especially at least 36 mm. The upper limit of diameter is preferably up to 42 mm, especially up to 40 mm. The weight is preferably 20 to 32 grams, especially 27 to 30 grams.

With respect to the material of which the cover is made, at least one layer which constitutes the cover is formed primarily of a mixture of components (A) and (B), a mixture of components (A), (B) and (C), or a mixture of components (A), (B) and (D);

(A) a thermoplastic resin composition selected from among a thermoplastic block copolymer, polyester base elastomer, polyamide base elastomer and polyolefin, which are modified with functional groups having reactivity with isocyanate, (B) an isocyanate compound or an isocyanate mixture having at least two isocyanate groups as functional groups in a molecule, (C) an ionomer resin, and (D) a thermoplastic polyurethane elastomer. It is noted that the term "primarily" generally means that the mixture accounts for at least 50% by weight, especially at least 60% by weight, based on the overall weight of the cover material.

(A) Thermoplastic Resin Composition

The thermoplastic resin composition suitable for use as component (A) is a thermoplastic block copolymer, a polyester base elastomer, a polyamide base elastomer or a polyolefin, with the thermoplastic block copolymer, polyester base elastomer or polyolefin being especially preferred.

Suitable examples of the thermoplastic block copolymers include those composed of crystalline polyethylene blocks (C) and/or crystalline polystyrene blocks (S) as hard segments and polybutadiene blocks (B), polyisoprene blocks (I), relatively random copolymer structure blocks (EB) of ethylene and butylene, and relatively random copolymer structure blocks (EP) of ethylene and propylene as soft segments, preferably relatively random copolymer structure blocks (EB) of ethylene and butylene and relatively random copolymer structure blocks (EP) of ethylene and propylene, and more preferably relatively random copolymer structure blocks (EB) of ethylene and butylene.

Suitable examples of the thermoplastic block copolymers include S-EB-S, S-B-S, S-I-S, S-EB, S-EB-S-EB, S-EP-S, S-EB-C, S-B-C, S-I-C, S-EP-C, C-EB-C, C-B-C, C-I-C, C-EB, C-EB-C-EB, C-EP-C, etc. A choice of crystalline polystyrene blocks (S) as the hard segments is preferred for moldability, and the inclusion of crystalline polyethylene blocks (C) in the hard segments is preferred for resilience.

When the thermoplastic block copolymer is a block copolymer of C-EB-C, S-EB-C or S-EB-S type, it can be obtained by hydrogenating butadiene or a styrene-butadiene copolymer.

The polybutadiene or styrene-butadiene copolymer used in hydrogenation is preferably a polybutadiene in which the butadiene structure contains 1,4 polymer blocks which are at least 95 wt % composed of 1,4 units, and the overall butadiene structure has a 1,4 unit content of at least 50 wt %, and more preferably at least 80 wt %.

The degree of hydrogenation in the hydrogenation product, expressed as the percent of double bonds in the polybutadiene or styrene-butadiene copolymer that are converted to saturated bonds, is preferably 60 to 100%, and more preferably 90 to 100%. Too low a degree of hydrogenation may lead to deterioration such as gelation in the blending step with the ionomer resin or the like, and cause problems of weatherability and impact durability to the cover in the completed golf ball.

In the thermoplastic block copolymer, the hard segment content is preferably 10 to 50% by weight, more preferably 15 to 50% by weight. A hard segment content which is too high may result in so low a flexibility as to keep the objects of the invention from being effectively achieved, whereas a hard segment content which is too low may give rise to problems in molding of the blend.

Preferably the thermoplastic block copolymer has a number average molecular weight of 30,000 to 800,000.

The thermoplastic block copolymer has a melt index at 230° C. of preferably 0.5 to 15 g/10 min, and more preferably 1 to 7 g/10 min. Outside the range, problems such as weld lines, sink marks and short shots may arise during injection molding.

The preferred polyolefins are those derived from a monomer component having 2 to 8 carbon atoms, for example, ethylene, propylene, 1-butene, isobutylene, 1-pentene or 1-octene. Of these, ethylene, propylene and the like are especially preferred.

In the polyolefin, a component other than the above monomer component may be added as a comonomer for flexibilizing purposes. Such additional components include acrylates such as methyl acrylate, ethyl acrylate and butyl acrylate, methacrylates such as methyl methacrylate, ethyl methacrylate and butyl methacrylate, vinyl acetate, and the like. Of these, acrylates and methacrylates are preferred from the standpoint of compatibility with ionomer resins.

Those polyolefins which are polymerized in the presence of metallocene catalysts can also be used in order to improve impact resistance.

The polyester base elastomers are primarily constructed of hard segments formed of a high melting crystalline polymer comprising crystalline aromatic polyester units and soft segments formed of a low melting polymer segment comprising aliphatic polyether units and/or aliphatic polyester units.

The high melting crystalline polymer is preferably polybutylene terephthalate derived from terephthalic acid and/or dimethyl terephthalate and 1,4-butanediol. Other examples include polyesters derived from a dicarboxylic acid component such as isophthalic acid, phthalic acid, naphthalene-2,6-dicarboxylic acid, naphthalene-2,7-dicarboxylic acid, diphenyl-4,4'-dicarboxylic acid, diphenoxyethane dicarboxylic acid, 5-sulfoisophthalic acid or ester-forming derivatives thereof; and diols having a molecular weight of not more than 300, for example, aliphatic diols such as ethylene glycol, trimethylene glycol, pentamethylene glycol, hexamethylene glycol, neopentyl glycol, and decamethylene glycol, alicyclic diols such as 1,4-cyclohexane dimethanol and tricyclodecane dimethylol, and aromatic diols such as xylylene glycol, bis(p-hydroxy)diphenyl, bis(p-hydroxyphenyl)propane, 2,2-bis[4-(2-hydroxyethoxy)phenyl]propane, bis[4-(2-hydroxy)phenyl]sulfone, 1,1-bis[4-(2-hydroxyethoxy)phenyl]cyclohexane, 4,4'-dihydroxy-p-terphenyl and 4,4'-dihydroxy-p-quarterphenyl. Also useful are polyesters copolymerized using more than one dicarboxylic acid component and more than one diol component. It is also possible to blend those polyesters in which a tri- or polyfunctional component such as a polyfunctional carboxylic acid component, polyfunctional oxyacid component or polyfunctional hydroxy component is copolymerized with the foregoing components in an amount of up to 5 mol %.

The low melting polymer is a low melting polymer segment comprising aliphatic polyether units and/or aliphatic polyester units.

Examples of the aliphatic polyether include poly(ethylene oxide) glycol, poly(propylene oxide)glycol, poly(tetramethylene oxide)glycol, poly(hexamethylene oxide)glycol, copolymers of ethylene oxide and propylene oxide, ethylene oxide-added polymers of poly(propylene oxide)glycol, and copolymers of ethylene oxide and tetrahydrofuran. Examples of the aliphatic polyester include poly(ε-caprolactone), polyenantholactone, polycaprylolactone, polybutylene adipate, and polyethylene adipate. Of these, poly(tetramethylene oxide)glycol, ethylene oxide-added polymers of poly(propylene oxide)glycol, poly(ε-caprolactone), polybutylene adipate, and polyethylene adipate are preferred because of the elastic properties of the resulting polyester block copolymers, with poly(tetramethylene oxide)glycol being especially preferred.

The low melting polymer segment preferably has a number average molecular weight of about 300 to about 6,000, as copolymerized.

In the polyester base elastomer used herein, provided that the total copolymerized amount of the high melting crystalline polymer component and the low melting polymer component is 100% by weight, the low melting polymer component is generally incorporated in an amount of preferably at least 15% by weight, especially at least 50% by weight, and preferably up to 90% by weight as the upper limit. A proportion of the low melting polymer component incorporated beyond the range may fail to provide sufficient melt properties for injection molding, and may impede melt blending and uniform mixing whereas too low a proportion may fail to provide sufficient flexibility and resilience.

While the polyester base elastomer used herein is a copolymer comprising the high melting crystalline polymer component and the low melting polymer component as predominant components, the preparation method thereof is not critical. It may be prepared by well-known methods. Exemplary are methods (a) to (e) described below, any of which may be advantageously employed.

(a) Method of effecting transesterification of a low alcohol diester of dicarboxylic acid, an excess of a low molecular weight glycol, and a low melting polymer segment component in the presence of a catalyst, followed by polycondensation of the reaction product.

(b) Method of effecting esterification of a dicarboxylic acid, an excess of a glycol, and a low melting polymer segment component in the presence of a catalyst, followed by polycondensation of the reaction product.

(c) Method of preforming a high melting crystalline segment, adding a low melting segment component thereto, and effecting transesterification for randomization.

(d) Method of linking a high melting crystalline segment to a low melting polymer segment using a concatenating agent.

(e) Method of effecting addition of ϵ-caprolactone monomer to a high melting crystalline segment when poly(ϵ-caprolactone) is used as the low melting polymer segment.

It is recommended that the polyester base elastomer used herein have a hardness (Shore D hardness) of typically at least 10, preferably at least 20, and as the upper limit, up to 50, especially up to 40, as measured according to ASTM D-2240. It is also preferred that the polyester base elastomer exhibit a high rebound resilience, typically of at least 40%, preferably at least 50%, and up to 90%, as measured according to the BS Standard 903. If the rebound resilience is too low, the molded part of the inventive resin composition itself may have a low resilience so that the golf ball comprising the molded part sometimes degrades its flight performance.

It is further preferred that the polyester base elastomer have a relatively low flexural modulus, typically of at least 5 MPa, preferably at least 10 MPa, more preferably at least 15 MPa, and as the upper limit, up to 250 MPa, preferably up to 200 MPa, more preferably up to 150 MPa, as measured according to JIS K-7106. If the flexural modulus is too high, the molded part of the inventive resin composition may have too high a rigidity so that the golf ball comprising the molded part sometimes degrades its feel on impact and durability.

The polyamide base elastomer is a thermoplastic elastomer having both hard segments of polyamide and soft segments of polyether within a molecule.

An exemplary thermoplastic polyamide base elastomer is commercially available under the trade name of Daiamid PAE from Daicel-Huels Co., Ltd.

The thermoplastic resin composition used herein has functional groups having reactivity with isocyanate. Examples of suitable functional groups include maleic anhydride groups, hydroxyl groups and amino groups, with the maleic anhydride groups being especially preferred.

Commercial products may be used as the styrenic elastomer having maleic anhydride groups, for example, maleic anhydride-modified products of styrene-ethylene/butylene-styrene copolymers (SEBS) commercially available under the trade name of "Tuftec M series" from Asahi Kasei Chemicals Corporation.

Examples of maleic anhydride-containing polyolefins include "Polybond" (maleic anhydride-modified polyolefin) manufactured by Uniroyal, "Bondine" (ethylene-ethyl acrylate-maleic anhydride terpolymer) marketed from Sumitomo Chemical Industries Co., Ltd., and "A-C Polyethylene" (ethylene-maleic anhydride copolymer) manufactured by Honeywell, which are advantageously used herein.

The thermoplastic resin composition should have a sufficient degree of modification to react with isocyanate to form a molecular network, with those compositions modified only at molecular ends being excluded.

(B) Isocyanate Compound or Isocyanate Mixture

The isocyanate mixture (B) is a dispersion of an isocyanate compound having at least two isocyanate groups as functional groups in a molecule (b-1) in a thermoplastic resin which is substantially non-reactive with isocyanate (b-2). Suitable isocyanate compounds (b-1) used herein include those used in the prior art relating to thermoplastic polyurethane materials, for example, aromatic diisocyanates such as 4,4'-diphenylmethane diisocyanate, 2,4-toluene diisocyanate and 2,6-toluene diisocyanate, and aliphatic diisocyanates such as hexamethylene diisocyanate, but are not limited thereto. Notably, 4,4'-diphenylmethane diisocyanate is most preferred from the standpoints of reactivity and operational safety.

The thermoplastic resin (b-2) is preferably a resin which is less water-absorptive and fully compatible with thermoplastic polyurethane materials. Suitable resins include polystyrene resins, polyvinyl chloride resins, ABS resins, polycarbonate resins, and polyester elastomers (polyether-ester block copolymers, polyester-ester block copolymers, etc.). Of these, polyester elastomers are preferred for rebound resilience and strength, with polyether-ester block copolymers being especially preferred.

In the isocyanate mixture (B), the thermoplastic resin (b-2) and the isocyanate compound (b-1) are mixed in a weight ratio between 100:5 and 100:100, especially between 100:10 and 100:40. If the amount of isocyanate compound (b-1) blended relative to thermoplastic resin (b-2) is too small, a larger amount of (B) must be added in order to provide sufficient addition for the crosslinking reaction with (A), and (b-2) exerts more effects to offset physical properties of (C). If the amount of isocyanate compound (b-1) is too large, it may cause slippage to occur during mixing, hindering the synthesis of mixture (B).

The isocyanate mixture (B) can be prepared by blending isocyanate compound (b-1) into thermoplastic resin (b-2) and thoroughly kneading them together on mixing rolls or a Banbury mixer at a temperature of 130 to 250° C., followed by pelletization or cooling and grinding. The isocyanate mixture (B) may advantageously be a commercial product, an example of which is Crossnate EM30 by Dainichi Seika Colour & Chemicals Mfg. Co., Ltd.

Herein, the amounts of the above-described components (A) and (B) are preferably adjusted such that the mixing proportion of components (A) and (B) falls between 100:1 and 100:30 in weight ratio. More preferably components (A) and (B) are mixed in a weight ratio between 100:5 and 100:25, especially between 100:10 and 1000:20. Too less component (B) may lead to a decline of scuff resistance whereas too much component (B) may exacerbate molding.

(C) Ionomer Resin

The ionomer resin (C) used herein may be any of such resins which have been used in the art as the golf ball cover stock. The preferred ionomer resin (C) contains (c-1) an olefin-unsaturated carboxylic acid binary random copolymer and/or a metal ion-neutralized product of an olefin-unsaturated carboxylic acid binary random copolymer and (c-2) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer.

The olefins used in component (c-1) or (c-2) are preferably alpha-olefins. Examples of suitable alpha-olefins include ethylene, propylene, and 1-butene, with ethylene being especially preferred. The olefins may be used in admixture of any.

The unsaturated carboxylic acids used in component (c-1) or (c-2) are preferably α,β-unsaturated carboxylic acids having 3 to 8 carbon atoms. Examples of suitable α,β-unsaturated carboxylic acids having 3 to 8 carbon atoms include acrylic acid, methacrylic acid, ethacrylic acid, itaconic acid, maleic acid, and fumaric acid, with acrylic acid and methacrylic acid being especially preferred. The unsaturated carboxylic acids may be used in admixture of any.

The unsaturated carboxylic acid esters used in component (c-2) are preferably lower alkyl esters of the foregoing unsaturated carboxylic acids. Typical are those esters obtained by reacting the foregoing unsaturated carboxylic acids with lower alcohols such as methanol, ethanol, propanol, n-butanol and isobutanol. Esters of acrylic acid and esters of methacrylic acid are especially preferred. Illustrative examples include methyl methacrylate, ethyl methacrylate, propyl methacrylate, butyl methacrylate, methyl acrylate, ethyl acrylate, propyl acrylate, and butyl acrylate, with butyl acrylate (n-butyl acrylate and isobutyl acrylate) being especially preferred. The unsaturated carboxylic acid esters may be used in admixture of any.

In preparing the above-described olefin-unsaturated carboxylic acid copolymer and olefin-unsaturated carboxylic acid-unsaturated carboxylic acid ester copolymer, any additional monomer may be copolymerized as long as the objects of the invention are not impaired.

It is preferred that the content of unsaturated carboxylic acid in these copolymers be 5 to 20% by weight for component (c-1) and 1 to 10% by weight for component (c-2). Too low an unsaturated carboxylic acid content may lead to losses of rigidity and resilience so that the golf ball degrades its flight performance. Too high an unsaturated carboxylic acid content may lead to insufficient flexibility.

It is also preferred that the content of unsaturated carboxylic acid ester in component (c-2) be 12 to 45% by weight. Too low an unsaturated carboxylic acid ester content may fail to achieve the flexibilizing effect whereas too high an unsaturated carboxylic acid ester content may decline resilience.

When the above-described components (c-1) and (c-2) are used in blend, their amounts are preferably in a weight ratio (c-1)/(c-2) between 100/0 and 25/75, more preferably between 100/0 and 50/50. Too much amounts of component (c-2) may lead to insufficient resilience.

As the ionomer resin (C) used herein, those obtained by neutralizing the foregoing copolymers with mono- to trivalent metal ions of at least one type are preferred. Examples of mono- to trivalent metal ions suitable for neutralization include sodium, potassium, lithium, magnesium, calcium, zinc, aluminum, ferrous and ferric ions. Such metal ions may be introduced into the foregoing copolymers, for example, by reacting the copolymers with suitable compounds of mono- to tri-valent metal ions such as hydroxides, methoxides, ethoxides, carbonates, nitrates, formates, acetates and oxides.

The degree of neutralization of carboxylic acid in the copolymer with metal ions is preferably at least 10 mol %, more preferably at least 30 mol % and up to 100 mol %, more preferably up to 90 mol % based on the carboxylic acid groups. Too low a degree of neutralization may lead to a low resilience.

From the standpoint of resilience improvement, it is advantageous to use a mixture of a monovalent metal ionomer and a divalent metal ionomer. In this case, the former and the latter are preferably mixed in a weight ratio between 20/80 and 80/20.

It is known that two or more ionomer resins containing different mono-, di- or tri-valent metal ions are blended in suitable amounts to form an ionomer resin blend capable of endowing an ionomer resin-based layer with a good balance of resilience and durability. Blending ionomer resins in such combination is also preferred in the practice of the invention.

Commercial products may be used as the ionomer resin (C), for example, "Surlyn" by E.I. Dupont and "Himilan" by Dupont-Mitsui Polychemicals Co., Ltd.

In the practice of the invention, the amounts of components (A), (B) and (C) are preferably adjusted such that components (A)+(C) and component (B) are in a weight ratio between 100:1 and 100:30. More preferably, components (A)+(C) and component (B) are in a weight ratio between 100:5 and 100:25, especially between 100:10 and 100:20. Too less component (B) may lead to a decline of scuff resistance whereas too much component (B) may interfere with molding.

Also, the amounts of components (A) and (C) are preferably adjusted such that component (A) and component (C) are in a weight ratio between 10:90 and 90:10. More preferably, component (A) and component (C) are in a weight ratio between 20:80 and 80:20, especially between 30:70 and 70:30. Too less component (A) may fail to improve the feel on impact whereas too much component (A) may lead to a decline of resilience.

(D) Thermoplastic Polyurethane

The thermoplastic polyurethane material has a structure which is composed of soft segments made of a polymeric polyol (polymeric glycol) and hard segments made of a chain extender and a diisocyanate. The polymeric polyol used herein as a starting material is not subject to any particular limitation, and may be any that is used in the prior art relating to thermoplastic polyurethane materials. Exemplary polymeric polyols include polyester polyols and polyether polyols, although polyether polyols are better than polyester polyols for synthesizing thermoplastic polyurethane materials having a high rebound resilience and excellent low-temperature properties. Suitable polyether polyols include polytetramethylene glycol and polypropylene glycol. Polytetramethylene glycol is especially preferred for rebound resilience and low-temperature properties. The polymeric polyol has an average molecular weight of preferably 1,000 to 5,000. To synthesize a thermoplastic polyurethane material having a high rebound resilience, an average molecular weight of 2,000 to 4,000 is especially preferred.

Preferred chain extenders include those used in the prior art relating to thermoplastic polyurethane materials. Illustrative, non-limiting examples include 1,4-butylene glycol, 1,2-ethylene glycol, 1,3-butanediol, 1,6-hexanediol and 2,2-dimethyl-1,3-propanediol. These chain extenders have an average molecular weight of preferably 20 to 15,000.

Preferred diisocyanates include those used in the prior art relating to thermoplastic polyurethane materials. Illustrative, non-limiting examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. It is noted that certain types of isocyanate are difficult to control the crosslinking reaction during injection molding. To ensure stable reaction of the thermoplastic polyurethane material with the isocyanate mixture (B) as will be described later, it is most preferable to use 4,4'-diphenylmethane diisocyanate, a typical aromatic diisocyanate.

The most preferred thermoplastic polyurethane material used herein is a thermoplastic polyurethane material which is synthesized from a polyether polyol and an aromatic diisocyanate wherein the polyether polyol is a polytetramethylene glycol having an average molecular weight of at least 2,000 and the aromatic diisocyanate is 4,4'-diphenylmethane diisocyanate.

Commercial products may be suitably used as the above-described thermoplastic polyurethane material. Illustrative examples include Pandex T-8290, T-8295 and T-8260 manufactured by DIC Bayer Polymer, Ltd., and Resamine 2593 and 2597 manufactured by Dainichi Seika Colour & Chemicals Mfg. Co., Ltd.

In the practice of the invention, the amounts of components (A), (B) and (D) are preferably adjusted such that components (A)+(D) and component (B) are in a weight ratio between 100:1 and 100:30. More preferably, components (A)+(D) and component (B) are in a weight ratio between 100:5 and 100:25, especially between 100:10 and 100:20. Too less component (B) may lead to a decline of scuff resistance whereas too much component (B) may interfere with molding.

Also, the amounts of components (A) and (D) are preferably adjusted such that components (A) and (D) are in a weight ratio between 10:90 and 90:10. More preferably, components (A) and (D) are in a weight ratio between 20:80 and 80:20, especially between 30:70 and 70:30. Too less component (A) may fail to improve resilience whereas too much component (A) may worsen the feel on impact.

One exemplary method of preparing the cover involves kneading a composition of components excluding component (B), for example, component (A) alone, a mixture of (A) and (C), or a mixture of (A) and (D) on a single or twin screw extruder, forming the composition into pellets, dry mixing the pellets with component (B) at room temperature, and molding the mixture around the core to form a cover by means of an injection molding machine. The injection molding temperature, which varies with the type of thermoplastic resin material used, is generally in a range of 120 to 300° C.

With respect to the reaction and crosslinking modes of the golf ball cover prepared as above, it is contemplated that the thermoplastic resin composition as component (A) is crosslinked with component (B) to form a network structure, for example, or in the event component (D) is included, components (A) and (D) are crosslinked with component (B) for integration. In this event, crosslinking reaction has not fully proceeded immediately after injection molding of the cover molding material, but is promoted by annealing after the molding, so that the material acquires effective properties as the golf ball cover. The term "annealing" means a treatment of heating and aging the cover at a certain temperature for a certain time or aging the cover at room temperature for a certain time.

The hardness of the cover is preferably adjusted to a Shore D hardness of 20 to 70, especially 30 to 60. The gage of the cover is preferably adjusted to 0.5 to 2.5 mm, especially 1.1 to 2.0 mm.

It is noted that the type of the inventive golf ball is not limited to a two-piece golf ball having a solid core enclosed with a cover. The inventive golf ball can be embodied as solid golf balls including three-piece solid golf balls and multi-piece golf balls of three or more layer structure, one-piece golf balls, and thread-wound golf balls as well. The invention is applicable to all types of golf balls.

The golf ball of the invention has an excellent overall profile of three properties, flight performance, feel on impact, and scuff resistance.

EXAMPLE

Examples and Comparative Examples are given below for illustrating the invention although the invention is not limited to the Examples.

Examples 1–5 & Comparative Examples 1-7

Using core materials based on cis-1,4-polybutadiene, a solid core A having a diameter of 38.6 mm, a weight of 35.2 g and a deflection amount of 2.9 mm under an applied load of 100 kg, and a solid core B having a diameter of 38.6 mm, a weight of 33.5 g and a deflection amount of 2.9 mm under an applied load of 100 kg were obtained. A pellet-form composition was obtained by mixing components (A), (C) and (D) selected from the composition shown in the following Table, on a kneader type twin-screw extruder at 200° C.

By weighing the above composition and component (B) so as to provide a blending proportion shown in Table, dry blending them, and injection molding the blend into a mold having the solid core held therein, a golf ball having a single layer cover with a gage of 2.05 mm was manufactured (see FIG. 1).

Ball Hardness the deflection amount (mm) of the ball under an applied load of 100 kg Initial Velocity An initial velocity was measured using the same type of initial velocity instrument as the USGA rotary drum initial velocity instrument approved by R&A. The ball was conditioned at a temperature of 23±1° C. for at least 3 hours and tested in a chamber at room temperature of 23±2° C. The ball was hit with a head having a striking mass of 250 pounds (113.4 kg) at a hitting speed of 143.8 ft/s (43.83 m/s). One dozen of balls were hit each four times, and the time of passage across a distance of 6.28 feet (1.91 m) was measured, from which the initial velocity was computed. This cycle was completed within about 15 minutes.

Ball Properties/Scuff Resistance

After the balls were held at 23° C., they were normally hit at three positions for each ball by means of a swing robot equipped with a pitching wedge at a head speed of 37 m/s. The three struck areas were evaluated according to the criterion below.

Point 5 ball surface remain intact or faint club face marks left 4 noticeable club face marks, but no fluff on cover surface 3 fluff and outstanding burring on ball surface 2 fluff and cracks on ball surface 1 chafed dimples Feel on Impact Five skilled amateur golfers actually shot the ball with a driver (W#1) and a putter. The feel on impact of the ball was rated as follows. The rating of feel given by most golfers is assigned to each ball.

○: soft

Δ: ordinary

X: hard

It is seen from the results in Table 1 that the golf balls of Examples are excellent in ball rebound, scuff resistance and feel on impact, whereas the golf balls of Comparative Examples are poor in scruff resistance and feel on impact, failing to acquire an overall profile of ball properties.

The invention claimed is:

1. A method of preparing a golf ball by injection molding a cover of one or more layers around a core, comprising mixing (A) a thermoplastic resin composition selected from among a thermoplastic block copolymer, polyester base elastomer, polyamide base elastomer and polyolefin, which are modified with functional groups having reactivity with isocyanate, with (B) an isocyanate compound or an isocyanate mixture having at least two isocyanate groups as functional groups in a molecule, at room temperature, and injection molding a resin material primarily comprising the mixture around the core, wherein the thermoplastic resin composition modified with functional groups having reactivity with isocyanate does not comprise a thermoplastic modified only at molecular ends with functional groups having reactivity with isocyanate.

TABLE 1

| | Example | | | | | Comparative Example | | | | | | |
|---|---|---|---|---|---|---|---|---|---|---|---|---|
| | 1 | 2 | 3 | 4 | 5 | 1 | 2 | 3 | 4 | 5 | 6 | 7 |
| Core | A | A | A | A | B | A | A | A | A | B | B | A |
| (A) Tuftec M1953 | 100 | 70 | 30 | 70 | 30 | 100 | 70 | 30 | 70 | 30 | | |
| (C) Himilan 1605 | | 15 | 35 | | | | 15 | 35 | | | | 50 |
| Himilan 1706 | | 15 | 35 | | | | 15 | 35 | | | | 50 |
| (D) Pandex T8295 | | | | 15 | 35 | | | | 15 | 35 | 50 | |
| Pandex T8260 | | | | 15 | 35 | | | | 15 | 35 | 50 | |
| (B) Crossnate EM-30 | 10 | 10 | 10 | 10 | 10 | | | | | | | |
| Ball hardness (mm) | 2.9 | 2.8 | 2.6 | 2.9 | 2.9 | 2.8 | 2.7 | 2.5 | 2.8 | 2.8 | 2.8 | 2.4 |
| Initial velocity (m/s) | 76.5 | 76.7 | 77.0 | 76.6 | 76.5 | 76.5 | 76.7 | 77.0 | 76.6 | 76.5 | 76.4 | 77.2 |
| Scuff resistance | 5 | 5 | 5 | 5 | 5 | 4 | 3 | 3 | 3 | 3 | 4 | 4 |
| Feel on impact | ○ | ○ | ○ | ○ | ○ | ○ | ○ | Δ | ○ | ○ | ○ | X |

* Numerical values in Table are in parts by weight.

Tuftec M1953:

maleic anhydride-modified thermoplastic block copolymer by Asahi Kasei Chemicals Corp.

Himilan 1706:

Zn ion-neutralized product of ethylene-methacrylic acid copolymer ionomer by Dupont-Mitsui Polychemicals Co., Ltd.

Himilan 1605:

Na ion-neutralized product of ethylene-methacrylic acid copolymer ionomer by Dupont-Mitsui Polychemicals Co., Ltd.

Pandex T8295:

thermoplastic polyurethane elastomer by DIC Bayer Polymer Ltd.

Pandex T8260:

thermoplastic-polyurethane elastomer by DIC Bayer Polymer Ltd.

Crossnate EM-30:

isocyanate mixture by Dainichi Seika Colour & Chemicals Mfg. Co., Ltd.

2. The method of preparing a golf ball of claim 1, wherein in component (A), the functional group having reactivity with isocyanate is a maleic anhydride, hydroxyl or amino group.

3. The method of preparing a golf ball of claim 1, wherein a mixing proportion of component (A) to component (B) is between 100:1 and 100:30 in weight ratio.

4. The method of preparing a golf ball of claim 1, wherein component (B) comprises an isocyanate mixture comprising a dispersion of an isocyanate compound having at least two isocyanate groups as functional groups in a molecule (b-1) in a thermoplastic resin which is substantially non-reactive with isocyanate (b-2).

5. A golf balls comprising a core and a cover of one or more layers, wherein at least one layer which constitutes said cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, (B) an isocyanate compound or an isocyanate mixture having at least two isocyanate groups as functional groups in a molecule, and (C) an ionomer resin, wherein the thermoplastic resin composition modified with functional groups having reactivity with isocyanate does not comprise a thermoplastic modified only at molecular ends with functional groups having reactivity with isocyanate.

6. The golf ball of claim 5, wherein in component (A), the functional group having reactivity with isocyanate is a maleic anhydride, hydroxyl or amino group.

7. The golf ball of claim 5, wherein a mixing proportion of the sum of components (A) and (C) to component (B) is between 100:1 and 100:30 in weight ratio.

8. The golf ball of claim 5, wherein component (B) comprises an isocyanate mixture comprising a dispersion of an isocyanate compound having at least two isocyanate groups as functional groups in a molecule (b-1) in a thermoplastic resin which is substantially non-reactive with isocyanate (b-2).

9. A golf ball, comprising a core and a cover of one or more layers, wherein at least one layer which constitutes said cover is formed primarily of a mixture of (A) a thermoplastic resin composition selected from among a thermoplastic block copolymer, polyester base elastomer, polyamide base elastomer and polyolefin, which are modified with functional groups having reactivity with isocyanate, (B) an isocyanate compound or an isocyanate mixture having at least two isocyanate groups as functional groups in a molecule, and (D) a thermoplastic polyurethane elastomer, wherein the thermoplastic resin composition modified with functional groups having reactivity with isocyanate does not comprise a thermoplastic modified only at molecular ends with functional groups having reactivity with isocyanate.

10. The golf ball of claim 9, wherein in component (A), the functional group having reactivity with isocyanate is a maleic anhydride, hydroxyl or amino group.

11. The golf ball of claim 9, wherein a mixing proportion of the sum of components (A) and (D) to component (B) is between 100:1 and 100:30 in weight ratio.

12. The golf ball of claim 9, wherein component (B) comprises an isocyanate mixture comprising a dispersion of an isocyanate compound having at least two isocyanate groups as functional groups in a molecule (b-1) in a thermoplastic resin which is substantially non-reactive with isocyanate (b-2).

13. A method of preparing a golf ball by injection molding a cover of one or more layers around a core, comprising kneading (A) a thermoplastic resin composition selected from among a thermoplastic block copolymer, polyester base elastomer, polyamide base elastomer and polyolefin, which are modified with functional groups having reactivity with isocyanate, with (C) an ionomer resin to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core, wherein the thermoplastic resin composition modified with functional groups having reactivity with isocyanate does not comprise a thermoplastic modified only at molecular ends with functional groups having reactivity with isocyanate.

14. The method of preparing a golf ball of claim 13, wherein component (B) comprises an isocyanate mixture comprising a dispersion of an isocyanate compound having at least two isocyanate groups as functional groups in a molecule (b-1) in a thermoplastic resin which is substantially non-reactive with isocyanate (b-2).

15. A method of preparing a golf ball by injection molding a cover of one or more layers around a core, comprising kneading (A) a thermoplastic resin composition selected from among a thermoplastic block copolymer, polyester base elastomer, polyamide base elastomer and polyolefin, which are modified with functional groups having reactivity with isocyanate, with (D) a thermoplastic polyurethane elastomer to form a first mixture, then mixing the first mixture with (B) an isocyanate compound or an isocyanate mixture having at least two isocyanate groups as functional groups in a molecule, at room temperature to form a second mixture, and injection molding a resin material primarily comprising the second mixture around the core, wherein the thermoplastic resin composition modified with functional groups having reactivity with isocyanate does not comprise a thermoplastic modified only at molecular ends with functional groups having reactivity with isocyanate.

16. The method of preparing a golf ball of claim 15, wherein component (B) comprises an isocyanate mixture comprising a dispersion of an isocyanate compound having at least two isocyanate groups as functional groups in a molecule (b-1) in a thermoplastic resin which is substantially non-reactive with isocyanate (b-2).

* * * * *